US007934699B2

(12) United States Patent
Zell et al.

(10) Patent No.: US 7,934,699 B2
(45) Date of Patent: May 3, 2011

(54) FENCE SYSTEM

(75) Inventors: William R. Zell, Dundas (CA); John-Paul Braaten, Calgary (CA)

(73) Assignee: Westech Building Products, Inc., Houston, TX (US)

( * ) Notice: Subject to any disclaimer, the term of this patent is extended or adjusted under 35 U.S.C. 154(b) by 355 days.

(21) Appl. No.: 11/477,025

(22) Filed: Jun. 28, 2006

(65) Prior Publication Data

US 2007/0012904 A1 Jan. 18, 2007

Related U.S. Application Data

(60) Provisional application No. 60/694,551, filed on Jun. 28, 2005.

(51) Int. Cl.
*E04H 17/16* (2006.01)

(52) U.S. Cl. ..... 256/24; 256/65.02; 256/65.06

(58) Field of Classification Search ..... 256/24, 256/59, 65.01, 65.02–65.08, 65.14, 73
See application file for complete search history.

(56) References Cited

U.S. PATENT DOCUMENTS

| | | | | | |
|---|---|---|---|---|---|
| 2,608,386 | A | * | 8/1952 | Hart | 256/65.06 |
| 3,458,052 | A | * | 7/1969 | Kann | |
| 3,685,866 | A | * | 8/1972 | Patenaude | 403/189 |
| 3,738,083 | A | * | 6/1973 | Shimano | |
| 3,770,245 | A | * | 11/1973 | Murdock | 256/65.08 |
| 3,879,017 | A | * | 4/1975 | Maxcy et al. | 256/65.08 |
| 3,924,834 | A | * | 12/1975 | Young | 256/59 |
| 4,390,165 | A | * | 6/1983 | Murdock | 256/59 |
| 4,623,128 | A | * | 11/1986 | Dutch et al. | 256/65.08 |
| 4,809,955 | A | | 3/1989 | Veilleux | |
| 5,078,367 | A | * | 1/1992 | Simpson et al. | 256/24 |
| 5,192,056 | A | | 3/1993 | Espinueva | |
| 5,606,919 | A | * | 3/1997 | Fox et al. | |
| 5,695,174 | A | | 12/1997 | Tsai | |
| 5,702,090 | A | * | 12/1997 | Edgman | 256/24 |
| D405,545 | S | | 2/1999 | Forbis | |
| D405,546 | S | | 2/1999 | Forbis | |
| D408,560 | S | | 4/1999 | Bruder | |
| 5,967,498 | A | * | 10/1999 | Junell | 256/59 |

(Continued)

FOREIGN PATENT DOCUMENTS

GB 2035409 6/1980

(Continued)

OTHER PUBLICATIONS

Prestige Vinyl Products, "PVP Easy Post Locator", date unknown.

*Primary Examiner* — Victor MacArthur
(74) *Attorney, Agent, or Firm* — Greenberg Traurig LLP

(57) ABSTRACT

A fence system having a post and a bracket. The post preferably has at least one longitudinal channel extending a length of the post, the channel being narrower at an opening of the channel than at an interior of the channel. The bracket preferably has an engagement member slidingly engaged with the channel of the post, and a rail receptacle housing adapted to support a rail. A method of assembling a fence comprising the steps of providing a post, inserting an end of a rail into a rail receptacle housing of a bracket, sliding an engagement member of the bracket into engagement with a dovetail-shaped channel extending the length of the post, and attaching the bracket to the post at a desired position.

14 Claims, 8 Drawing Sheets

U.S. PATENT DOCUMENTS

| | | | | |
|---|---|---|---|---|
| 5,988,599 | A | 11/1999 | Forbis | |
| 6,041,486 | A | 3/2000 | Forbis | |
| 6,202,987 | B1 | 3/2001 | Forbis | |
| 6,398,193 | B1 * | 6/2002 | DeSouza | 256/65.06 |
| 6,523,808 | B1 * | 2/2003 | Lehmann | 256/65.14 |
| 6,601,831 | B2 * | 8/2003 | Erwin | 256/24 |
| 6,755,394 | B2 * | 6/2004 | Forbis et al. | 256/65.01 |
| 6,805,335 | B2 * | 10/2004 | Williams | 256/65.06 |
| 7,086,341 | B2 * | 8/2006 | Peddicord | |
| 7,100,904 | B2 * | 9/2006 | Kim | 256/65.05 |
| 2002/0185640 | A1 * | 12/2002 | Heins | 256/65.01 |
| 2003/0213947 | A1 | 11/2003 | Takagi et al. | |
| 2003/0215375 | A1 * | 11/2003 | Peddicord | |
| 2004/0036064 | A1 | 2/2004 | Takagi et al. | |
| 2004/0206947 | A1 | 10/2004 | Rosaen | |
| 2005/0133777 | A1 | 6/2005 | Forbis et al. | |
| 2005/0242335 | A1 | 11/2005 | Bunn et al. | |
| 2006/0022188 | A1 * | 2/2006 | Collins, IV | 256/65.14 |

FOREIGN PATENT DOCUMENTS

| | | |
|---|---|---|
| GB | 2259924 | 3/1993 |

* cited by examiner

FENCE SYSTEM

CROSS-REFERENCE TO RELATED APPLICATION

This non-provisional patent application claims the benefit under §119(e) of U.S. Provisional Patent Application Ser. No. 60/694,551, filed Jun. 28, 2005, which is incorporated herein by reference.

BACKGROUND OF THE INVENTION

1. Field of the Invention

The present invention relates to fencing systems, in particular those which are formed of a plastic material, such as a vinyl plastic material, polyvinyl chloride ("PVC"), or polyethylene plastic.

2. Background of the Invention

Fences are commonly constructed for a variety of reasons. Two major problems with currently available fences are difficulty in construction and lack of durability. Fences formed of plastic materials have the potential to overcome these problems; however, previous plastic fence systems have included so many pieces that construction was made difficult, lacked sufficient flexibility of design to be useful in a variety of circumstances, or lacked the strength to hold up under rigorous use. An improved fence system preferably would address these shortcomings.

SUMMARY OF THE INVENTION

One embodiment of the present invention provides for a fence system having a post and a bracket. The post preferably has at least one longitudinal channel extending a length of the post, the at least one channel being narrower at an opening of the at least one channel than at an interior of the at least one channel. The bracket preferably has an engagement member slidingly engaged with the at least one channel of the post, and a rail receptacle housing adapted to support a rail. Another embodiment of the present invention provides for a fence system comprising two or more posts, four or more brackets, a top rail, a bottom rail, a length of pipe disposed within the bottom rail, and one or more planks. Each post preferably has four sides, at least one side having a longitudinal dovetail-shaped channel extending the length of the post, and each channel having an opening narrower than an interior of the channel. Each bracket preferably has a dovetail-shaped engagement member slidingly engaged with one of the channels, a rail receptacle housing adapted to support a rail, and a slot extending through a portion of the engagement member and a portion of the rail receptacle housing. Two rail receptacle housings preferably support a top rail and two different rail receptacle housings preferably support a bottom rail. A length of pipe disposed within the bottom rail provides strength and rigidity to the fence system. The planks preferably are supported by the top and bottom rails. A further embodiment of the present invention provides for a method of assembling a fence comprising the steps of providing a post, inserting an end of a rail into a rail receptacle housing of a bracket, sliding an engagement member of the bracket into engagement with a dovetail-shaped channel extending the length of the post, and attaching the bracket to the post at a desired position.

BRIEF DESCRIPTION OF THE DRAWING

Some of the features and benefits of the present invention having been stated, others will become apparent as the description proceeds when taken in conjunction with the accompanying drawings, in which:

FIG. 6 is a perspective view of another embodiment of a bracket according to the present invention.

DETAILED DESCRIPTION OF THE INVENTION AND SPECIFIC EMBODIMENTS

The present invention now will be described more fully hereinafter with reference to the accompanying drawings in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
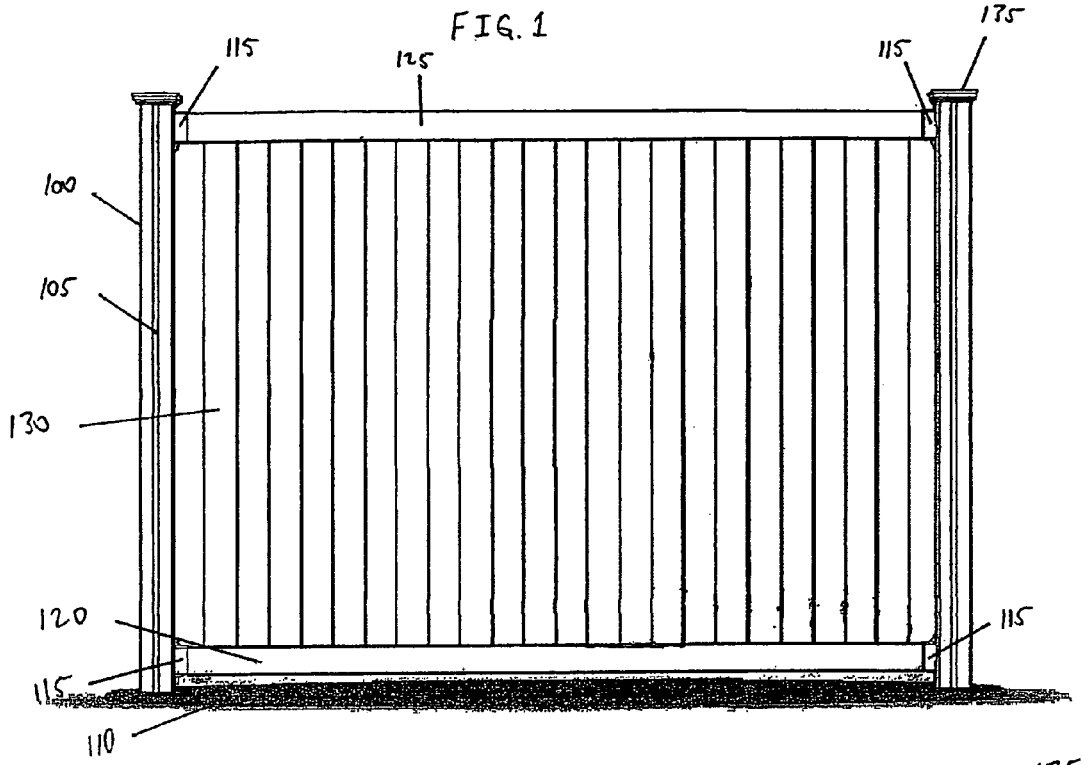
FIG. 1 is a front view of an embodiment of a fence system according to the present invention.

FIG. 1 is a front view of an embodiment of a fence system according to the present invention. Post 100 includes longitudinal channel 105 preferably extending the length of post 100. Post 100 may be anchored in section of ground 110 such as by burying a length of post 100 or by setting a length of post 100 in a quantity of concrete. More preferably, post 100 is mounted with a collar to a pole anchored in section of ground 110, as will be hereinafter described. Brackets 115 are engaged with channels 105 and attached to post 100. Brackets 115 support bottom rail 120 and top rail 125. Privacy panels 130 are supported by rails 120, 125. Post cap 135 optionally may be attached to a top of post 100.

Figure 2:
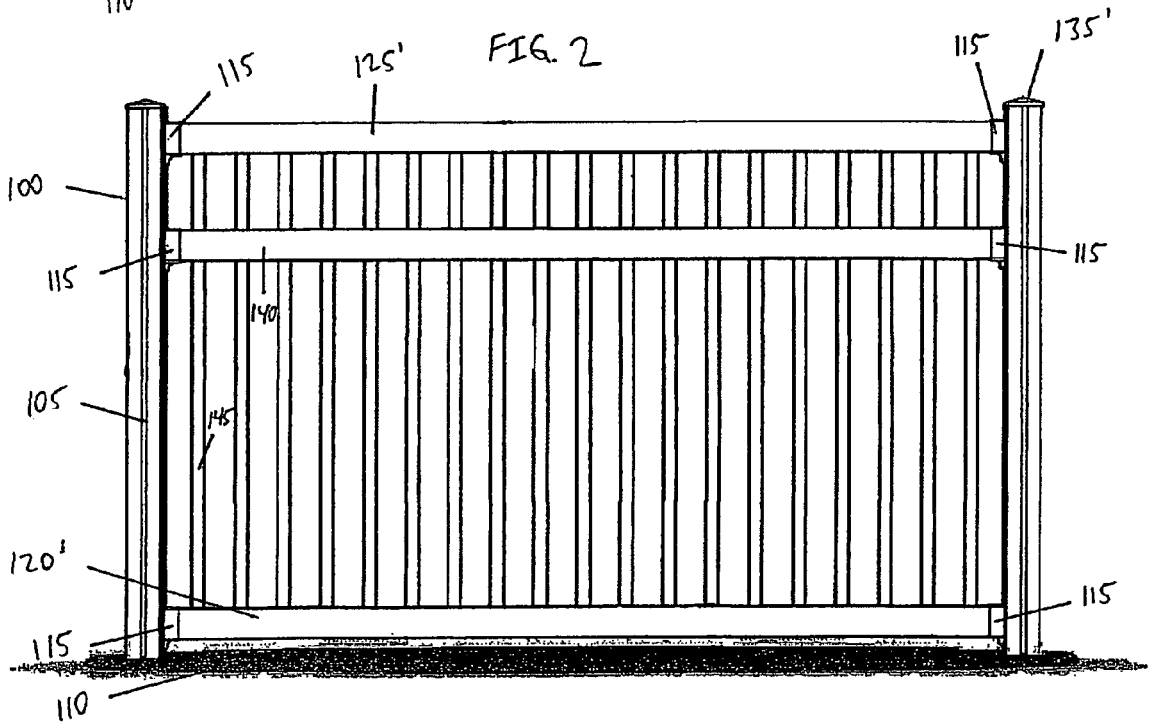
FIG. 2 is a front view of another embodiment of a fence system according to the present invention.

FIG. 2 is a front view of another embodiment of a fence system according to the present invention. Post 100 includes longitudinal channel 105 extending the length of post 100. Post 100 may be anchored in section of ground 110 such as by burying a length of post 100 or by setting a length of post 100 in a quantity of concrete. More preferably, post 100 is mounted with a collar to a pole anchored in section of ground 110, as will be hereinafter described. Brackets 115 are engaged with channels 105 and attached to post 100. Brackets 115 support bottom rail 120', top rail 125', and center rail 140. Pickets 145 are supported by rails 120', 125', and 140. Pickets 145 preferably extend through a series of holes in center rail 140. Post cap 135' optionally may be attached to a top of post 100. Privacy panels 130 and pickets 145 may be referred to generically as planks.

Figure 3:
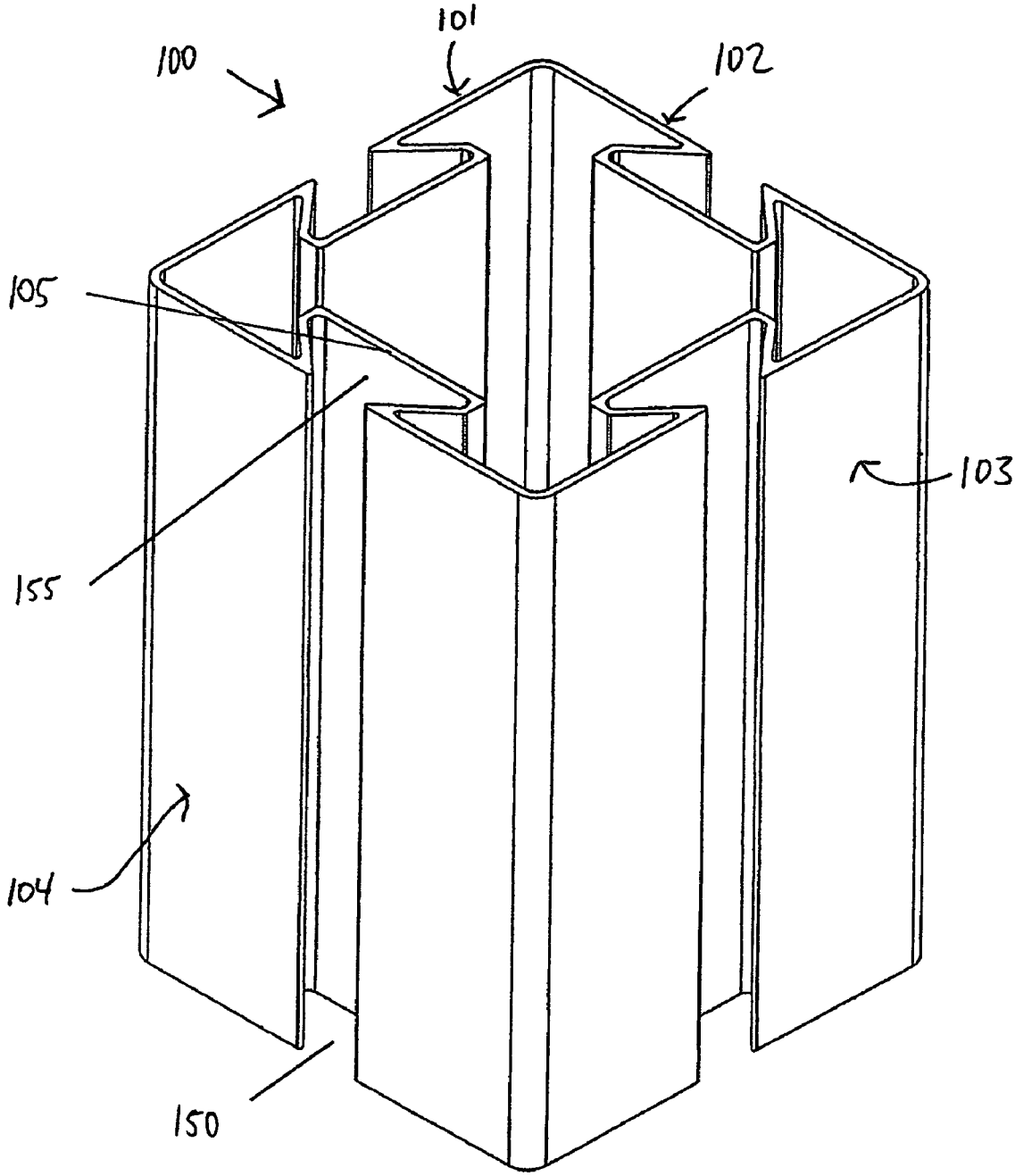
FIG. 3 is a perspective view of a section of a post according to the present invention.

FIG. 3 is a perspective view of a section of a post according to the present invention. Post 100 preferably has four sides 101, 102, 103, and 104, at least one side having a longitudinal dovetail-shaped channel 105 extending the length of the post. Two sides may be provided with channels 105, and preferably all four sides may be provided with channels 105, dependent upon the desired location of post 100 with respect to adjacent posts. Post 100 alternatively could be round or have a number of sides other than four. An opening 150 of channel 105 is narrower than an interior, or interior space, 155 of channel 105. The arrangement of channels 105 on the sides of post 100 advantageously permits post 100 to be used in a plurality of applications, such as an end post, a line post, a corner post, a 3-way post, or a center post.

Figure 4:
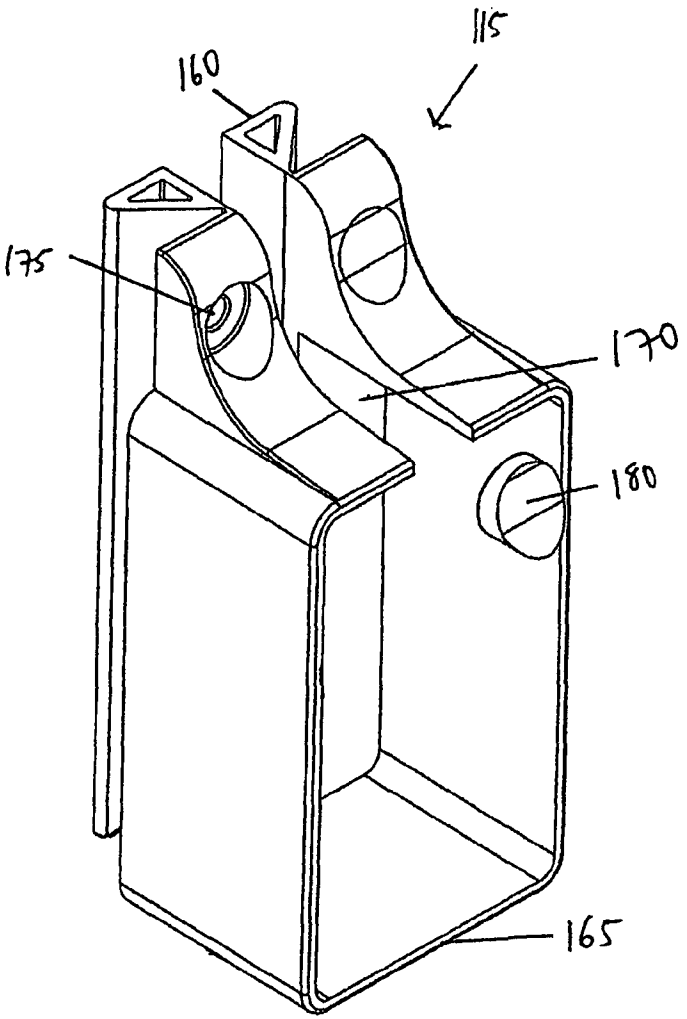
FIG. 4 is a perspective view of an embodiment of a bracket according to the present invention.

FIG. 4 is a perspective view of an embodiment of a bracket according to the present invention. Bracket 115 includes an engagement member 160 and a rail receptacle housing 165. Engagement member 160 preferably has a dovetail-shape. Bracket 115 preferably includes a slot 170 extending through a portion of engagement member 160 and rail receptacle housing 165. A screw hole 175 and cover 180 preferably are included as part of bracket 115.

Figure 5:
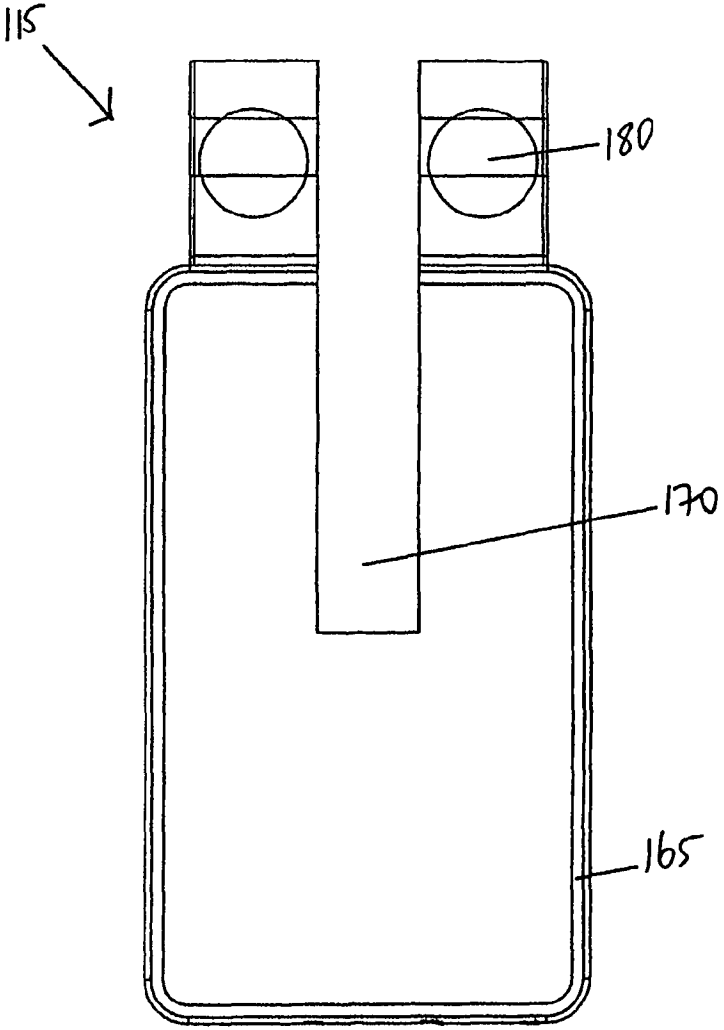
FIG. 5 is a front view of an embodiment of a bracket according to the present invention.

FIG. 5 is a front view of an embodiment of a bracket according to the present invention. Slot 170 can be seen extending through a portion of rail receptacle housing 165. Cover 180 is shown in place. Optionally, screw holes could be provided in rail receptacle housing 165 in addition to or instead of screw hole 175 illustrated in FIG. 4.

FIG. 6 is a perspective view of another embodiment of a bracket according to the present invention. Bracket 115' has a slightly different design from bracket 115 of FIGS. 4-5. Most significantly, an upper portion of engagement member 160' stands free from the body of bracket 115' and cover 180' snaps over screw hole 175'.

Figure 7:
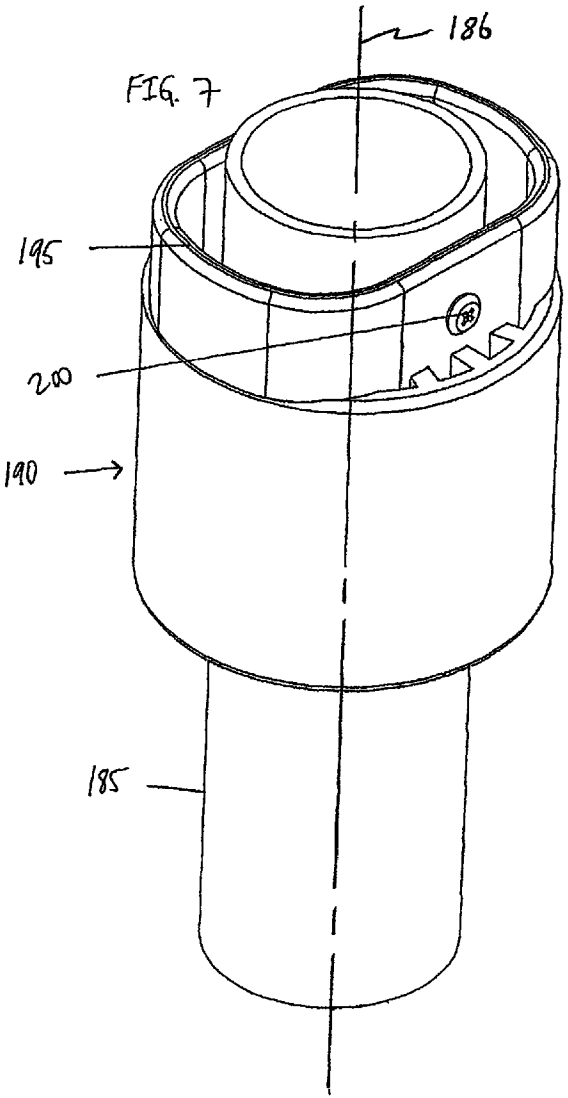
FIG. 7 is a perspective view of a collar mounted to a pole according to the present invention.

FIG. 7 is a perspective view of a collar mounted to a pole according to the present invention. Collar 190 includes aperture 195 having an oblong shape. Collar screw 200 secures collar 190 to pole 185. Pole 185 preferably comprises a length of galvanized pipe. Collar 190 may be used to compensate for pole 185 not having been anchored in a sufficiently vertical orientation.

Figure 8:
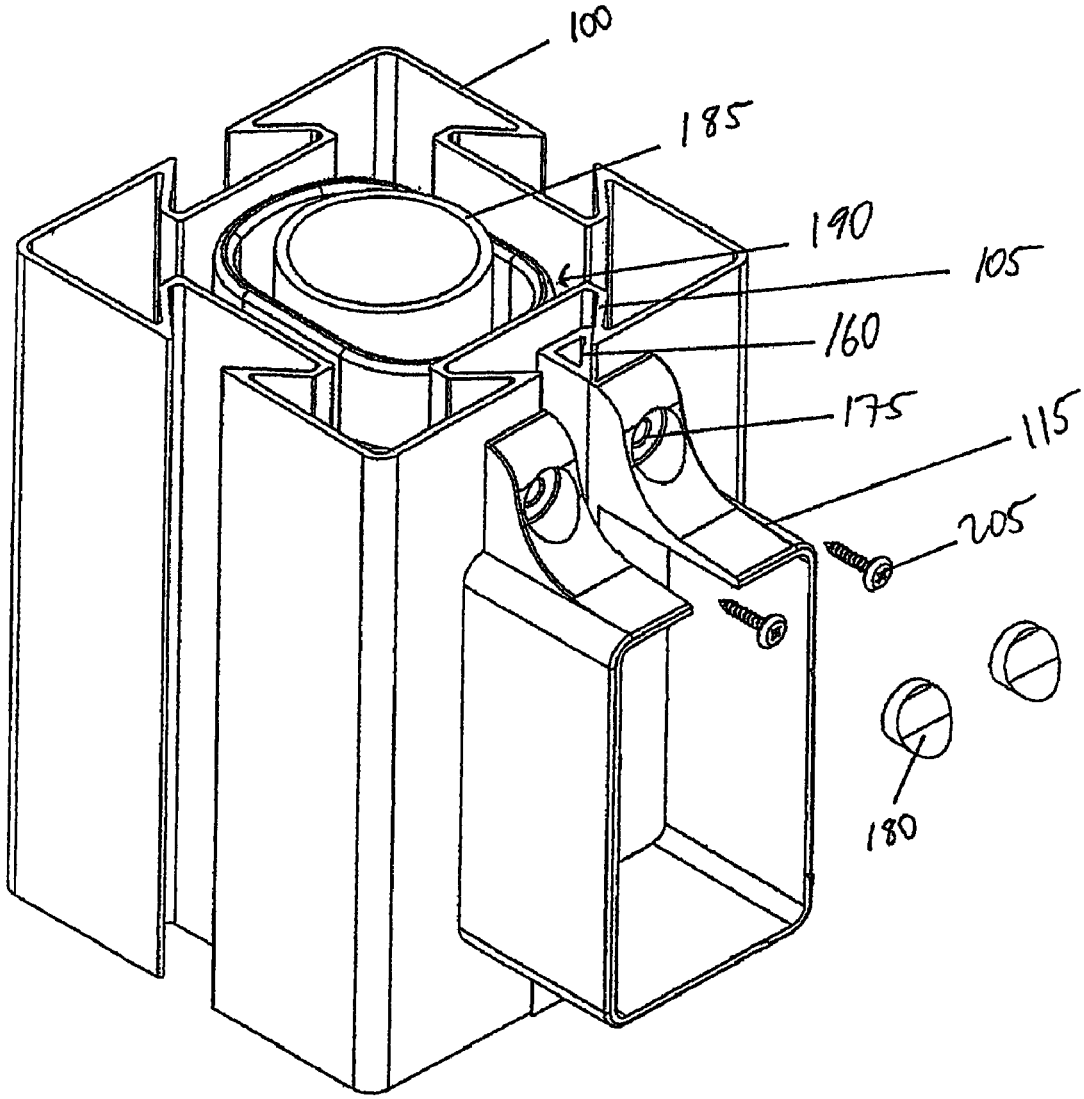
FIG. 8 is a perspective view of an embodiment of a fence system according to the present invention.
Figure 9:
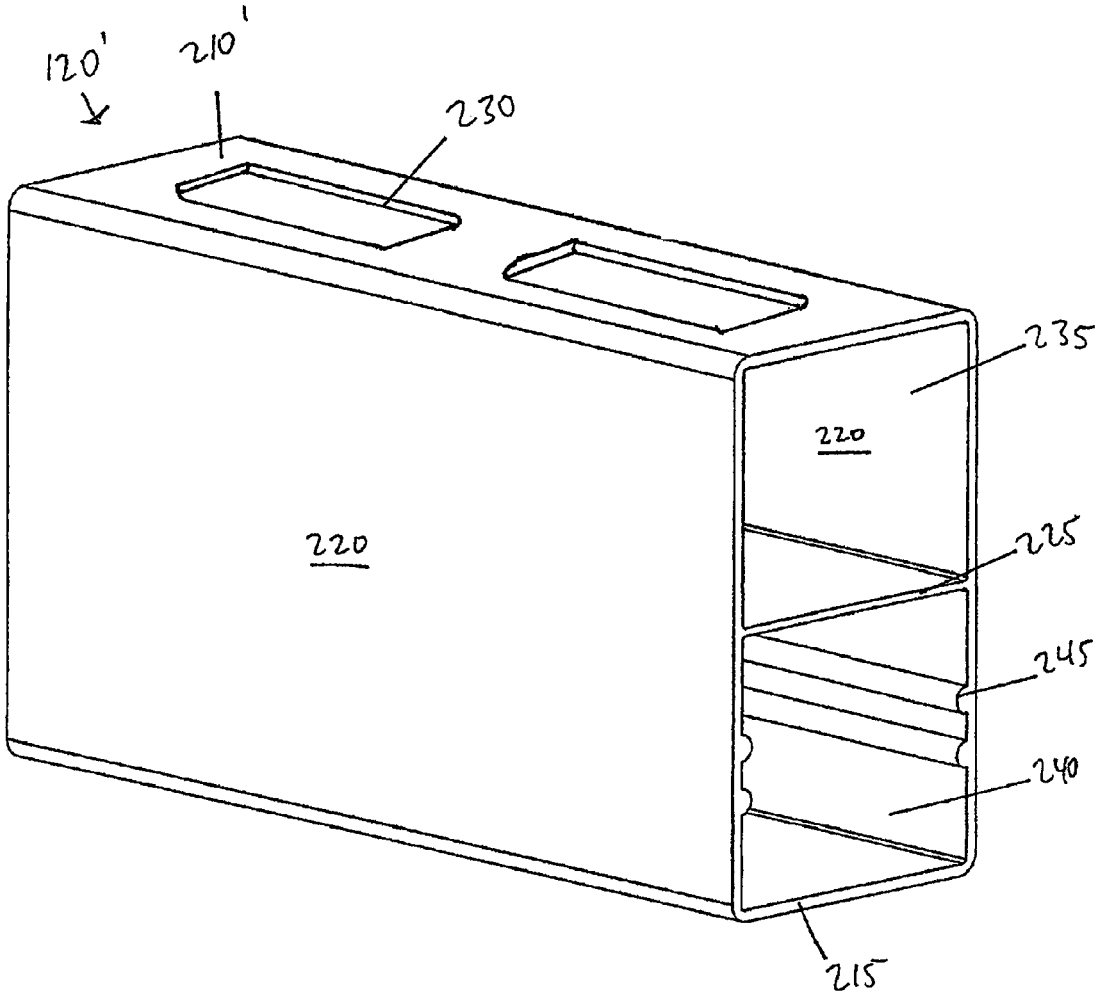

FIG. 8 is a perspective view of an embodiment of a fence system according to the present invention. Post 100 is shown mounted with collar 190 to pole 185. Channel 105 and engagement member 160 are engaged. Bracket 115 may be attached to post 100 by placing screws 205 through screw holes 175 and into post 100. Channel 105 and engagement member 160 preferably have a dovetail shape. The dovetail shape advantageously permits each screw 205 to penetrate multiple layers of material, thereby securely attaching bracket 115 to post 100 and helping to prevent screw 205 from backing out over time. More specifically, the dovetail arrangement sandwiches a portion of post 100 between engagement member 160 and the body of bracket 115, with screw 105 penetrating the post, the engagement member and the bracket. The sandwiching effect helps to hold bracket 115 firmly in place by creating a frictional fit. Covers 180 may be placed over screws 205 after screws 205 have been installed.

Figure 9:
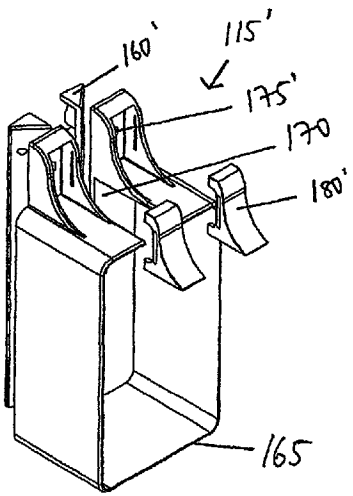
FIG. 9 is a perspective view of an embodiment of a length of rail according to the present invention.

FIG. 9 is a perspective view of an embodiment of a length of rail according to the present invention. Bottom rail 120' includes top side 210' bottom side 215, and lateral sides 220. Cross member 225 extends between lateral sides 220 creating an upper chamber 235 and a lower chamber 240. Lower chamber 240 may be provided with internal protrusions 245 to snugly and frictionally engage a length of pipe (not shown) disposed within chamber 240. Top side 210' of rail 120' includes a series of holes 230 adapted to accept one or more pickets of various sizes. A picket inserted into hole 230 may rest on cross member 225. Any of a variety of patterns of holes 230 may be provided. For example, holes 230 can be short to accommodate narrow pickets, long to accommodate wide pickets, spaced closely for privacy, or spaced farther apart for better visibility. Holes 230 also could form a staggered, overlapping pattern to create an arrangement of pickets providing privacy and resistance to high winds. Bottom rail 120' may be inverted to form top rail 125', in which case the designations for top and bottom and upper and lower would be reversed.

Figure 10:
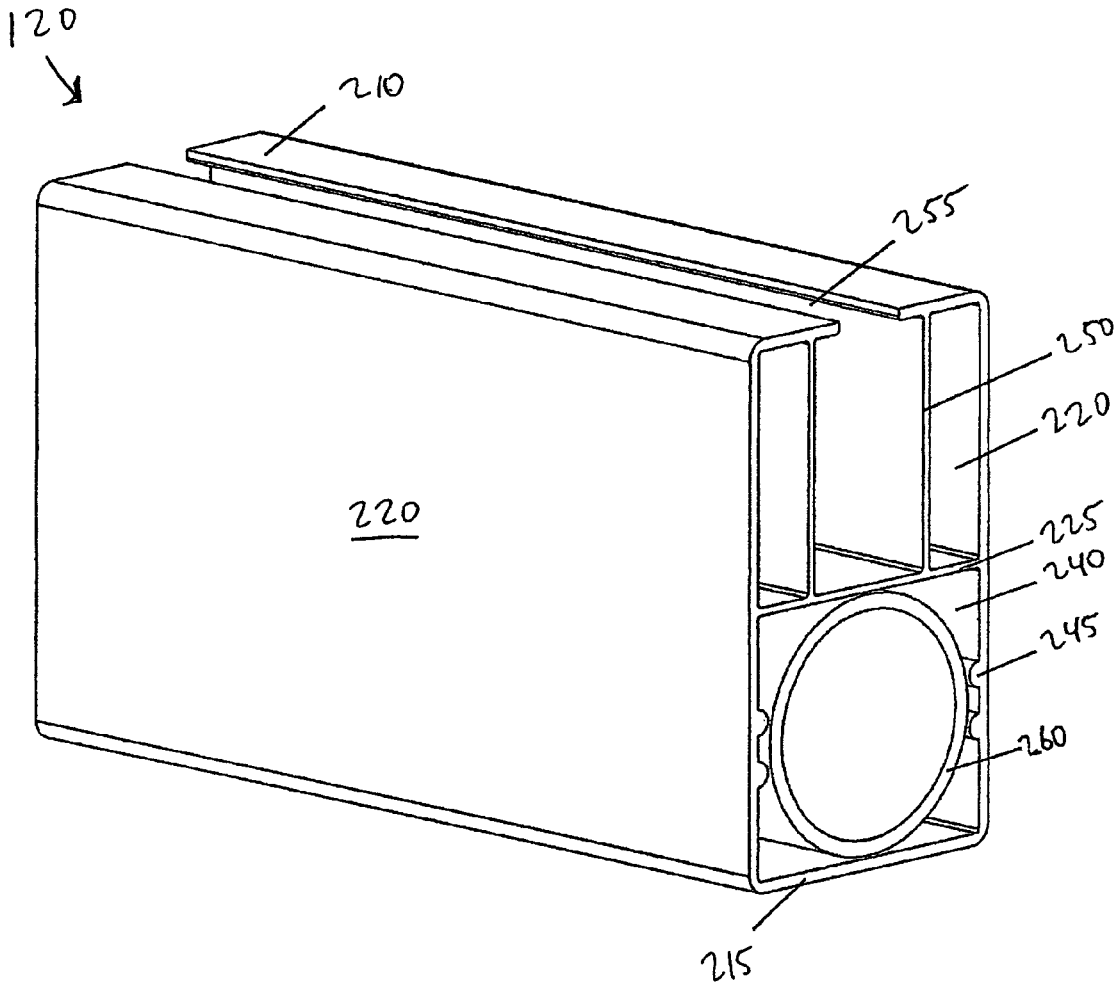
FIG. 10 is a perspective view of another embodiment of a length of rail according to the present invention.

FIG. 10 is a perspective view of another embodiment of a length of rail according to the present invention. Bottom rail 120 includes top side 210, bottom side 215, and lateral sides 220. Cross member 225 extends between lateral sides 220 creating a lower chamber 240. Lower chamber 240 may be provided with internal protrusions 245 to snugly and frictionally engage a length of pipe 260 disposed within chamber 240. Length of pipe 260 preferably comprises a length of galvanized pipe that acts to stiffen bottom rail 120. Slot walls 250 extend between cross member 225 and top side 210. Longitudinal slot 255 preferably extends the length of rail 120. A privacy panel inserted into slot 255 may rest on cross member 225. Bottom rail 120 may be inverted to form top rail 125, in which case the designations for top and bottom and upper and lower would be reversed.

Figure 11:
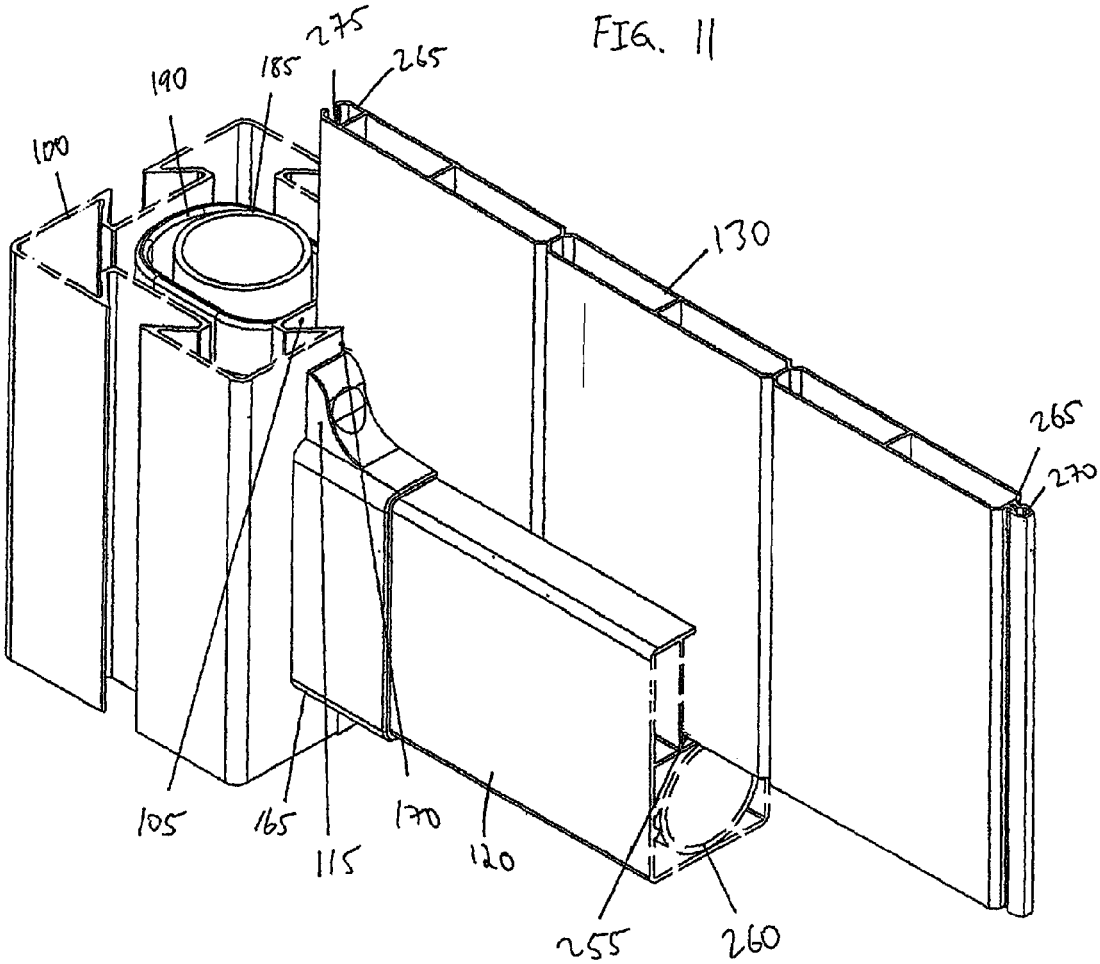
FIG. 11 is a perspective view of an embodiment of a fence system according to the present invention.

FIG. 11 is a perspective view of an embodiment of a fence system according to the present invention. Post 100 is shown mounted with collar 190 to pole 185. Bracket 115 is attached to pole 100 as previously described with respect to FIG. 8. Rail 120 is supported by rail receptacle housing 165 of bracket 115. Length of pipe 260 preferably is disposed within rail 120. Bracket 115 preferably is oriented so that slot 170 of bracket 115 aligns with slot 255 of rail 120. Privacy panel 130 includes vertical privacy panel ends 265. One vertical end 265 includes tongue 270 while the other vertical end 265 includes groove 275. Privacy panel 130 could be cut vertically, in which case vertical end 265 would include neither tongue 270 nor groove 275. Privacy panel 130 is supported by rail 120, rests within slot 255 of rail 120 and slot 170 of bracket 115, and fits within channel 105 of post 100. The fitting of a vertical end 265 of privacy panel 130 within channel 105 provides support to privacy panel 130 and contributes to a clean appearance even when privacy panel 130 has been cut vertically. Bracket 115 may be inverted to support top rail 125. Were bottom rail 120' illustrated in FIG. 9 to be used, rather than bottom rail 120, then bracket 115 preferably would be oriented so that slot 170 faced downward.

Figure 12:
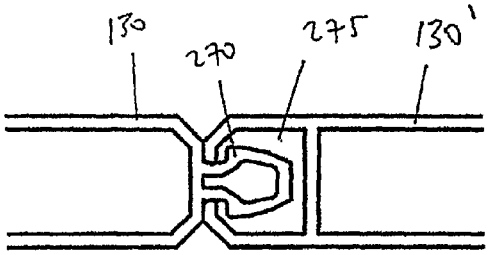
FIG. 12 is a top sectional view of portions of two privacy panels according to the present invention.

FIG. 12 is a top sectional view of portions of two privacy panels according to the present invention. Tongue 270 of first privacy panel 130 engages groove 275 of second privacy panel 130'. The first and second privacy panels may be engaged by sliding tongue 270 into groove 275. Alternatively, the first and second privacy panels may be engaged by snapping tongue 270 into groove 275. In either case, the first and second privacy panels preferably are attached so that the panels will not become separated under stress as is common in a traditional tongue and groove arrangement.

A method of assembling the fence system of the preceding figures also is provided. Post 100 may be anchored in a section of ground 110 in a conventional manner by burying a length of post 100 or by setting a length of post 100 in a quantity of concrete. Alternatively, pole 185 may be driven into section of ground 110 at the desired location of a post 100. Collar 190 then may be placed over an upper end of pole 185 and moved downwardly in a sliding relationship to its desired location along the longitudinal axis 186 of pole 185. An upper and a lower collar 190 may be disposed along the length of pole 185 in a spaced relationship, with each collar 190 preferably being disposed so that it will be adjacent to a bracket 115. Collar 190 then may be secured to pole 185 using collar screw 200. Post 100 next may be disposed over the upper end of pole 185 and moved downwardly toward section of ground 110 over pole 185 and collar 190. Collar 190 preferably includes an aperture 195 having an oblong shape that permits lateral adjustment of post 100 with respect to collar 190 and pole 185 as post 100 is slid downwardly over pipe 185 and collar 190. Further steps of the method preferably include inserting an end of a rail 120, 120', 125, 125', 140 into rail receptacle housing 165 of bracket 115, 115'; sliding engagement member 160, 160' into engagement with channel 105 of post 100, and attaching bracket 115, 115' to post 100 at a desired position such as with a screw. In the case of bottom rail 120, 120', the desired position for bracket 115, 115' should place bottom side 215 of rail 120, 120' approximately two inches above a surface of a section of ground 110.

In the drawings and specification, there have been disclosed embodiments of the invention and, although specific terms are employed, they are used in a generic and descriptive sense only and not for the purpose of limitation, the scope of the invention being set forth in the following claims.

What claimed is:

1. A fence system comprising:

at least a first and second fence post, each fence post having four sides, at least one side of each fence post having a longitudinal dovetail-shaped channel extending a length of the fence post, and each channel having an opening narrower than an interior of the channel;

at least a first, second, third, and fourth bracket, each bracket having a dovetail-shaped engagement member, a rail receptacle housing, and a slot extending through a portion of the engagement member and a portion of the rail receptacle housing, wherein the dovetail-shaped engagement members of the first and second brackets are slidingly engaged with the channel of the first fence post and the dovetail-shaped engagement members of the third and fourth brackets are slidingly engaged with the channel of the second fence post;

a top rail supported by two of the rail receptacle housings;

a bottom rail supported by the other of the two rail receptacle housings;

a length of pipe disposed within the bottom rail; and at least one plank supported by the top and bottom rails, wherein the plank is received within a portion of the channel extending a substantial portion of a length of the fence post and the slot extending through a portion of the engagement member and a portion of the rail receptacle housing.

2. The fence system of claim 1 wherein each fence post is anchored in a section of ground.

3. The fence system of claim 1 wherein each fence post is mounted with a collar to a pole anchored in a section of ground, wherein the collar includes an aperture having a generally oblong shape.

4. The fence system of claim 1 wherein each rail includes a longitudinal slot extending the length of the rail, the slot of the top rail open from a bottom side of the rail and the slot of the bottom rail open from a top side of the rail.

5. The fence system of claim 1 further comprising at least a first privacy panel and a second privacy panel.

6. The fence system of claim 5 wherein a tongue of the first privacy panel engages a groove of the second privacy panel.

7. The fence system of claim 5 wherein a vertical end of the one or more privacy panels fits within one of the channels.

8. The fence system of claim 1 wherein the one or more planks comprise one or more pickets, and each rail includes a series of holes adapted to accept the one or more pickets, the holes of the top rail open from a bottom side of the rail and the holes of the bottom rail open from a top side of the rail.

9. A fence system comprising:

at least a first and second fence post, each fence post having four sides, at least one side of each fence post having a longitudinal dovetail-shaped channel extending an entire length of the fence post, and each channel having an opening narrower than an interior of the channel;

at least two pairs of brackets, each bracket having a dovetail-shaped engagement member, a rail receptacle housing, and a slot extending through a portion of the engagement member and a portion of the rail receptacle housing, wherein the dovetail-shaped engagement members of the first pair of brackets are slidingly engaged with the channel of the first fence post and the dovetail-shaped engagement members of the second pair of brackets are slidingly engaged with the channel of the second fence post;

a top rail supported by two of the rail receptacle housings;

a bottom rail supported by the other of the two rail receptacle housings; and at least one plank supported by the top and bottom rails, wherein the one plank is received within a portion of the channel and the slot.

10. The fence system of claim 9 wherein each fence post is anchored in a section of ground.

11. The fence system of claim 9 wherein each fence post is mounted with a collar to a pole anchored in a section of ground, wherein the collar includes an aperture having a generally oblong shape.

12. The fence system of claim 9 wherein each rail includes a longitudinal slot extending the length of the rail, the slot of the top rail open from a bottom side of the rail and the slot of the bottom rail open from a top side of the rail.

13. The fence system of claim 9 further comprising at least a first privacy panel and a second privacy panel.

14. The fence system of claim 13 wherein a tongue of the first privacy panel engages a groove of the second privacy panel.

* * * * *